United States Patent [19]

Kodama

[11] Patent Number: 4,567,862

[45] Date of Patent: Feb. 4, 1986

[54] HYDRAULIC LIFTER DEVICE

[75] Inventor: Hisashi Kodama, Nagoya, Japan

[73] Assignee: Aisin Seiki Kabushiki Kaisha, Kariya, Japan

[21] Appl. No.: 548,096

[22] Filed: Nov. 2, 1983

[30] Foreign Application Priority Data

| | | | |
|---|---|---|---|
| Nov. 9, 1982 | [JP] | Japan | 57-170369[U] |
| Dec. 15, 1982 | [JP] | Japan | 57-219985 |
| Dec. 17, 1982 | [JP] | Japan | 57-191624[U] |

[51] Int. Cl.[4] ..... F01L 1/24

[52] U.S. Cl. ..... 123/90.55; 123/90.59

[58] Field of Search ..... 123/90.55, 90.59

[56] References Cited

U.S. PATENT DOCUMENTS

| | | | |
|---|---|---|---|
| 2,227,288 | 12/1940 | Voorheis et al. | 123/90.55 |
| 4,321,894 | 3/1982 | Black | 123/90.54 |
| 4,373,477 | 2/1983 | Buente et al. | 123/90.55 |

FOREIGN PATENT DOCUMENTS

| | | | |
|---|---|---|---|
| 1914693 | 2/1978 | Fed. Rep. of Germany | 123/90.55 |
| 3006644 | 9/1981 | Fed. Rep. of Germany | 123/90.55 |
| 3023686 | 1/1982 | Fed. Rep. of Germany | 123/90.55 |

OTHER PUBLICATIONS

European patent application, Buente, Jun. 1981, FIG. 8.

*Primary Examiner*—William R. Cline
*Assistant Examiner*—Peggy A. Neils
*Attorney, Agent, or Firm*—Oblon, Fisher, Spivak, McClelland & Maier

[57] ABSTRACT

The hydraulic lifter device for use in a valve train mechanism of an internal combustion engine comprises a body having a reservoir chamber of circular configuration therein, a plunger slidably positioned within the body to thereby form a leak clearance therebetween and biased by a spring in one direction, a pressure chamber formed within the plunger, and a check valve positioned between the reservoir and pressure chambers so as to allow a flow of a working fluid only into the pressure chamber from the reservoir chamber.

2 Claims, 6 Drawing Figures

HYDRAULIC LIFTER DEVICE

BACKGROUND OF THE INVENTION

1. Field of the Invention

This invention relates to hydraulic lifter devices and more particularly to a hydraulic lifter device installed in a valve train mechanism of an internal combustion engine.

2. Description of the Prior Art

In the prior internal combustion engine, a predetermined valve clearance is provided since there is a difference between thermal expansions of a cylinder head and a cylinder block and thermal expansions of a valve train mechanism. When the valve clearance is not properly maintained during the operation of the engine, noises will be occurred and the loss of the horse power will be occurred due to the blows of the crude gases. Therefore, the hydraulic lifter devices have been proposed to thereby maintain the valve clearance.

Such hydraulic lifter device includes a body having a reservoir chamber therein, a plunger disposed within the body so as to thereby define a pressure chamber, a check valve to allow a fluid flow only into the pressure chamber from the reservoir chamber and a leak clearance formed between the body and the plunger. The plunger is mechanically associated with a cam shaft and therefore the plunger is caused to be moved relative to the position of the body in response to the rotation of the cam shaft. More particularly, when the plunger is sunk relative to the position of the body, the fluid under pressure within the pressure chamber is flowed out through means of the leak clearance while when the plunger is extended relative to the position of the body, the check valve is caused to be opened to thereby allow the fluid flow into the pressure chamber from the reservoir chamber.

When the above hydraulic lifter device is installed in the inclined engine, namely, the mounting condition of the hydraulic lifter device is not perpendicular, however, the fluid within the reservoir chamber may be leaked through means of a fluid supplying passage which is formed in the body and leads to the reservoir chamber during the operation of the engine stops. Therefore, an air may be introduced within the pressure chamber from the reservoir chamber when the engine starts to operate. As a result, the plunger can not sink and extend by a predetermined distance and tapping noises will occur.

SUMMARY OF THE INVENTION

Therefore, it is an object of the present invention to provide a new and improved hydraulic lifter device which obviates the above prior drawbacks.

It is another object of the present invention to provide a new and improved hydraulic lifter device wherein an outflow of a fluid from a reservoir chamber is prevented.

It is still another object of the present invention to provide a new and improved hydraulic lifter device which is simple in construction and is high in durability.

According to the present invention, a hydraulic lifter device comprises a body hving a reservoir chamber therein, a plunger slidably positioned within a cylindrical portion of the body to thereby a leak clearance therebetween, a pressure chamber formed within the plunger, a check valve positioned between the reservoir and pressure chambers so as to allow a flow of a working fluid only into the pressure chamber from the reservoir chamber, a spring biasing the plunger in one direction, and the reservoir chamber being formed of circular configuration. Therefore, even when the hydraulic lifter device is inclined upon stopping of the operation of the engine, the working fluid sufficiently remains due to the specific circular configuration of the reservoir chamber.

BRIEF DESCRIPTION OF THE DRAWINGS

Other objects, features and advantages of the invention will become apparent from the following description of preferred embodiments of the invention with reference to the accompanying drawings wherein.

DETAILED DESCRIPTION OF THE PREFERRED EMBODIMENTS

Figure 1:
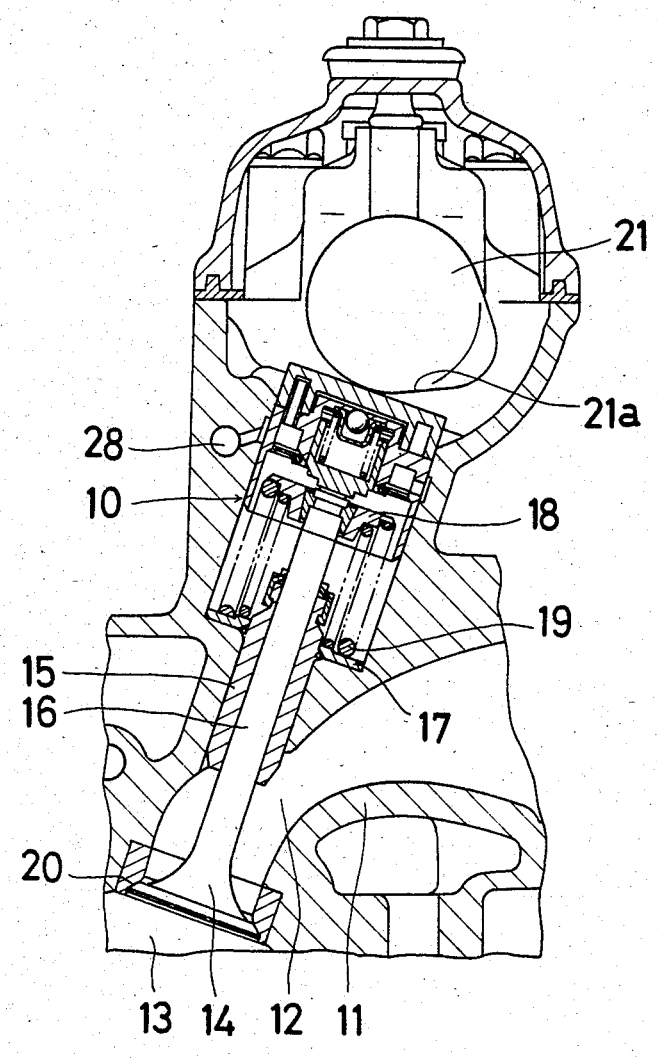
FIG. 1 is a partial sectional view of a valve train mechanism of an internal combustion engine having a hydraulic lifter device, therein, according to the present invention.

Referring now to to FIG. 1 showing a valve train mechanism of an internal engine in which a hydraulic lifter device 10 of OHC direct type according to the invention is incorporated, a fluid communication between a cylinder head port 12 formed in a cylinder head 11 and a combustion chamber 13 is controlled by means of an intake or exhaust valve 14. A valve stem 16 of the valve 14 is slidably supported by a valve guide 15 which is securely inserted in the cylinder head 11. A valve spring 19 is inserted between a spring seat 17 which is positioned on the upper end surface of the cylinder head 11 and a spring retainer 18 which is secured to the valve stem 16 so that the valve 14 is normally biased in its illutrated position where the valve 14 is seated against a valve seat 20. The hydraulic lifter device 10 is positioned within the cylinder head 11 and the upper end of the lifter device 10 is brought in contact with a cam surface 21*a* of a cam shaft 21 while the lower end of the lifter device 10 is brought in contact with the valve stem 16. As will be clear hereinafter, therefore, the hydraulic lifter device 10 repeats the up-and-down movement in response to the rotation of the cam shaft 21 so that the valve 14 repeats the opening and closing movement.

Figure 2:
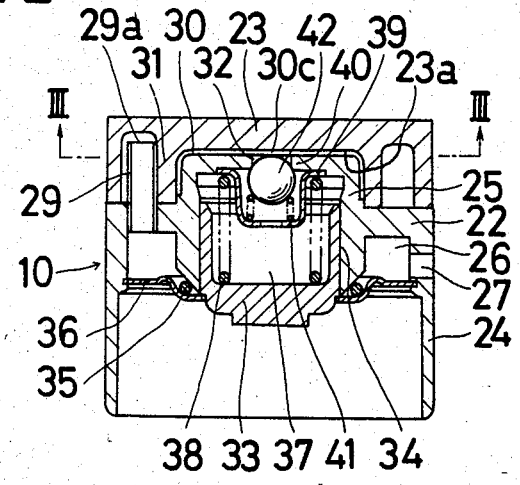
FIG. 2 is an enlarged sectional view of the hydraulic lifter device as shown in FIG. 1.
Figure 3:
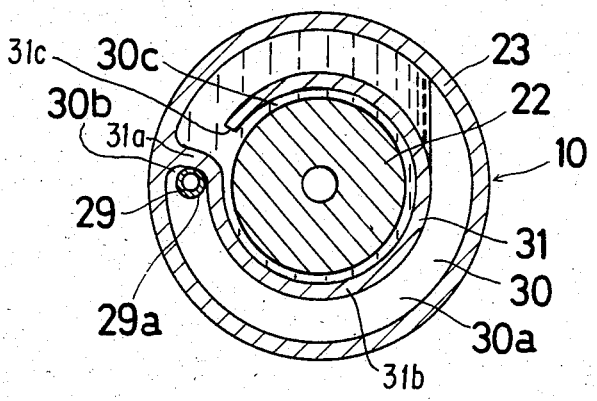
FIG. 3 is a sectional view taken along the line III—III of FIG. 2.

As best shown in FIGS. 2 and 3, the hydraulic lifter 10 includes a first metal portion 22 and a second plate-like portion 23 of wear-resisting sintered metal, both of the portions 22 and 23 being joined together by baking. The first portion 22 has an outer cylindrical portion 24 and an inner cylindrical portion 25 to thereby define a working oil passage 26 therebetween which receives a working oil from an oil supplying source such as oil pump through means of a passage 27 formed in the outer cylindrical portion 24 and a passage 28 formed in the cylinder head 11. The passage 26 is in fluid communication with a reservoir chamber 30 formed between both the portions 22 and 23 through means of a pipe 29 of metal material which is pressed into the first portion 22. The reservoir chamber 30 is formed into an inner chamber 30*c* and an outer chamber 30*a* of substantially annular cross section. The inner and outer chambers are formed by an elongate partition wall 31 integrally formed on the second portion 23 and comprising a first length 31*a* extending inwardly from an outer wall of the body, a second length 31*b* extending in a substantially circular arc from the first length, and ending short of the first length 31*a* in an end 31*c* defining an opening communicating the inner chamber 30*c* with the outer chamber 30*a*. An upper end 29*a* of the pipe 29 which acts as inlet for the reservoir 30 is opened to an outermost end portion 30*b* of the outer circular groove 30*a*.

A plunger 33 is slidably positioned within the inner cylindrical portion 25 of the first portion 22 so as to thereby define a leak clearance 34. The up-and-down movement of the plunger 33 is restricted by means of a stopper member 36 which is secured to the first portion 22 through means of a seal member 35, the stopper member 36 acting as seal member for the passage 26. Formed within the plunger 33 is a pressure chamber 37 which receives a spring 38, therein, which in turn biases the plunger 33 downwardly. An upper end of the spring 38 is seated against the first portion 22 through means of a retainer 39. A passage 32 formed in the first portion 22 completes the fluid communication between the inner circular groove 30*c* and the pressure chamber 37, and this passage 32 is controlled by a ball type check valve 42 which is constantly biased by means of a spring 41 in its position where the check valve 42 is seated against a seat 40 formed on the first portion 22. The upper surface of the second portion 23 is brought in contact with the cam surface 21*a* of the cam shaft 21 and the plunger 33 is brought in contact with the valve stem 16.

The upper end 29*a* of the pipe 29 is open above the level of an inner surface 23*a* of the second portion 23 which defines the roof of inner chamber 30*c* of reservoir chamber 30 in FIG. 2. Namely, the upper end 29*a* of the pipe 29 which acts as inlet and outlet ports for the working oil into and from the reservoir chamber 30 extends upwardly past the inner surface 23*a* of the second body 23 which defines the height of the inner chamber 30*c*. Therefore, the working oil does not flow out even when the position of the hydraulic lifter device 10 remains perpendicular upon stopping of the operation of the engine.

As mentioned above, the reservoir chamber 30 has the double circular grooves 30*a* and 30*c* and the upper end 29*a* of the pipe 29 which acts as inlet for the reservoir chamber 30 is formed close to the end portion 30*b* of the outer circular groove 30*a*. Even when the end 29*a* of the pipe 29 is in the lowest perpendicular position upon stopping of the operation of the engine, the working oil still remains as shown in FIG. 3. If the volume of the remaining oil is set larger than a volume which corresponds to a difference between minimum and maximum volumes of the pressure chamber 37 due to the relative movement between the portions 22 and 23 and the plunger 33, the working oil will be sufficiently secured when the engine starts. It is noted that in spite of the angle of the inclination of the hydraulic lifter device the desired working oil will be secured by means of the above partition wall.

In operation, the working oil for the hydraulic lifter device 10 is supplied to the pressure chamber 37 from the oil pump through means of the passage 27, the pipe 29, the reservoir 30 and the passage 32. When both the portions 22 and 23 are pushed down in response to the rotation of the cam shaft 21 mechanically connected to the engine, the oil pressure within the pressure chamber 37 increases and the check valve 42 remains in its closing position. At this time, the oil within the pressure chamber 37 is flowed out to the oil pan through means of the leak clearance 34. As a result, the plunger is sunk by the predetermined distance relative to the position of the portions. The bodies 22 and 23 are lifted by means of the spring 38 upon the further rotation of the cam shaft 21 and therefore the overall length of the lifter device extends by the predetermined distance. Therefore, the oil pressure within the pressure chamber 37 decreases so as to open the check valve 42 so that the oil within the reservoir chamber flows in the pressure chamber 37. The overall length of the hydraulic lifter device 10 returns in its original length. The above expansion and contraction of the hydraulic lifter device 10 will be repeated so that the valve clearance of the valve train mechanism will be maintained at zero.

Figure 4:
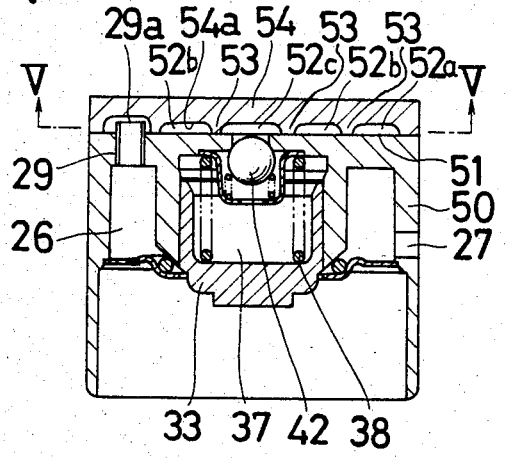
FIG. 4 is a view similar to FIG. 2, but showing a modification of the present invention.
Figure 5:
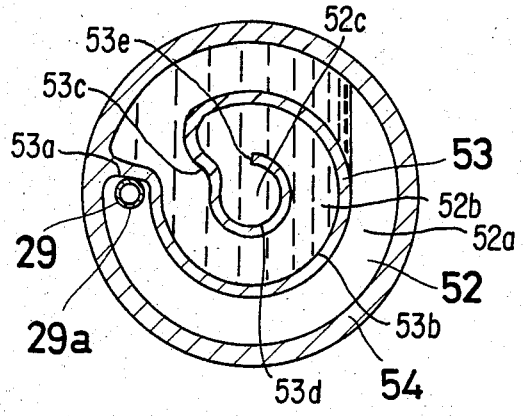
FIG. 5 is a sectional view taken along the line V—V of FIG. 4.

Referring now to FIGS. 4 and 5 showing a modification of the invention, the parts which are the same as those in the previous embodiment of the invention are illustrated by the same reference numerals. A first metal portion 50 has a substantial flat upper surface 51 to which a second sintered metal body 54 is secured. The second portion 54 has a double partition wall 53 to thereby define a triple reservoir chamber 52. In particular, reservoir chamber 52 comprises outer chamber 52*a*, having a substantially annular cross-section, intermediate chamber 52*b*, also having a substantially annular cross-section, and inner chamber 52*c*. Elongate partition wall 53 is integrally formed on the second portion 54 and comprises a first length 53*a* extending inwardly from an outer wall of the body, a second length 53*b* extending in a substantially circular arc from the first length, a third length 53*c* adjoining the end of the second length and forming a transition to a fourth length 53*d* extending in a substantially circular arc to the end 53*e*, the end 53*e* defining an opening to the inner chamber. The fourth length is concentric with the second length. As will be the same in the previous embodiment, the working oil, as shown in FIG. 5, is secured upon stopping of the operation of the engine. The upper end 29*a* of the pipe 29 extends above an inner surface 54*a* of the second portion 54.

Figure 6:
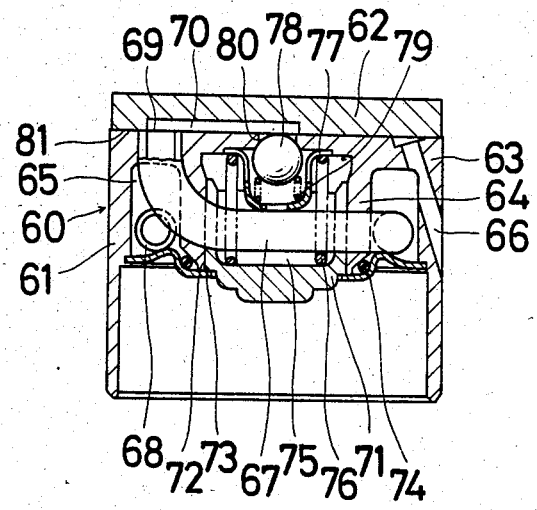
FIG. 6 is a view similar to FIG. 2, but showing a further modification of the present invention.

Referring now to FIG. 6 showing a further modification of the invention, a hydraulic lifter device 60 includes a first metal portion 61 and a second plate-like portion 62 of wear-resisting sintered metal, both of the portions 61 and 62 being joined together by baking. The first portion 61 has an outer cylindrical portion 63 and an inner cylindrical portion 64 to thereby define a first annular reservoir chamber 65 therebetween. The reservoir chamber 65 is adapted to receive a working oil from an oil source through means of an oil supplying passage 66 formed in the outer cylindrical portion 63. The first reservoir chamber 65 is always in fluid communication with a second reservoir chamber 67 of pipe configuration which turns through approximately 360 degrees round the cylindrical portion 67 within the first reservoir chamber 65. One end 68 of the second reservoir chamber 67 is opened to the first reservoir chamber 65 while the other end 69 thereof is opened to an oil passage 70 formed between the first and second bodies 61 and 62. As a result, both of the ends 68 and 69 are opened at the same side of the hydraulic lifter device 60, namely, at the opposite side of the passage 66.

A plunger 71 is slidably positioned within the inner cylindrical portion 64 of the portion 61 so as to thereby form a leak clearance 72 therebetween. The up-and-down movement of the plunger 71 is restricted by means of a stopper member 73 which is secured to the first portion 61 through means of a seal member 74, the stopper member 73 acting as seal member for the reservoir chamber 65. Formed within the plunger 71 is a pressure chamber 75 which receives a spring 76, therein, which in turn biases the plunger 71 downwardly. An upper end of the spring 76 is seated against the first portion 61 through means of a retainer 77. The fluid communication between the passage 70 and the pressure chamber 75 is controlled by means of a ball type check vale 78 which is constantly biased by means of a spring 79 in its position where the check valve 78 is seated against a seat 80 formed on the first portion 61.

Even when the passage 66 is in the lowest perpendicular position upon stopping of the operation of the engine, the working oil is secured within the second reservoir chamber 67 due to the specific configuration of the second reservoir chamber 67 mentioned above and there is no problem when the engine starts. The volume of the second reservoir chamber 67 is preferably set larger than a volume which corresponds to a difference between minimum and maximum volumes of the pressure chamber 75 due to the relative movement between the portions 61 and 62 and the plunger 71. Since the working oil is secured within the second reservoir chamber 67, an air escape hole 81 may be provided between both of the portions 61 and 62.

In the above embodiments of the invention, the oil passage is not formed in the plunger and in the cylindrical portion of the body which forms the leak clearance in cooperation with the plunger. Therefore, running the length of the plunger, the leak clearance acts effectively and, as a result, the overall length of the hydraulic lifter device may be small-sized in comparison with the hydraulic lifter device in which the oil passage is formed in the plunger.

While the invention has been particularly shown and described with respect to preferred embodiments thereof, it will be understood by those in the art that various changes in form and detail can be made therein without departing from the spirit and scope of the invention.

What is claimed as new and desired to be secured by Letters Patent of the United States is:

1. A hydraulic lifter device for use in a valve train mechanism of an internal combustion engine, comprising:

a body having first and second portions, said first portion comprising a cylindrical inner portion disposed therein;

a reservoir chamber formed between said first and second portions;

a plunger slidably disposed in said cylindrical inner portion of said first portion of said body;

a pressure chamber formed in said cylindrical inner portion of said first portion of said body and being communicable with said reservoir chamber;

a check valve provided between said reservoir chamber and said pressure chamber for allowing fluid flow only from said reservoir chamber into said pressure chamber; and a leakage clearance provided between an outer peripheral portion of said plunger and an inner peripheral portion of said cylindrical inner portion, said reservoir chamber comprising at least an inner chamber and an outer chamber of substantially annular cross-section disposed about and in fluid communication with said inner chamber, said inner and outer chambers being formed in part by an elongate wall comprising a first length extending inwardly from an outer wall of said body, a second length extending in a substantially circular arc from said first length, and an end defining an opening to said inner chamber, said inner chamber being communicable with said pressure chamber through said check valve, said body further comprising port means for introducing fluid into said outer chamber, said reservoir chamber further comprising an intermediate chamber of substantially annular cross-section disposed about said inner chamber, within said outer chamber, and in fluid communication with both, said elongate wall further comprising a third length adjoining said second length and a fourth length extending in a substantially circular arc between said third length and said end, said fourth length being concentric with said second length.

2. A hydraulic lifter device for use in a valve train mechanism for an internal combustion engine, comprising:

a body having first and second portions, said first portion comprising an outer cylindrical portion and an inner cylindrical portion, said inner cylindrical portion being spaced from said outer cylindrical portion to define an annular first fluid reservoir therebetween;

a fluid passage formed between said first and second portions;

a second fluid reservoir formed by a pipe disposed in said first fluid reservoir and looping about said cylindrical inner portion such that first and second open ends of said pipe are disposed substantially adjacent each other, said first end of said pipe being open to said first fluid reservoir, said second end of said pipe being open to said fluid passage;

a plunger slidably disposed in said inner cylindrical portion of said first portion of said body;

a presure chamber formed in said inner cylindrical portion of said first portion of said body and being communicable with said fluid passage; and a check valve between said fluid passage and said pressure chamber for allowing fluid flow only from said fluid passage into said pressure chamber.

* * * * *